US010174272B2

(12) United States Patent
Lagona

(10) Patent No.: US 10,174,272 B2
(45) Date of Patent: Jan. 8, 2019

(54) DISPERSANT VISCOSITY INDEX IMPROVER-CONTAINING LUBRICANT COMPOSITIONS AND METHODS OF USE THEREOF

(71) Applicant: Afton Chemical Corporation, Richmond, VA (US)

(72) Inventor: Jason Lagona, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 15/837,379

(22) Filed: Dec. 11, 2017

(65) Prior Publication Data

US 2018/0105764 A1 Apr. 19, 2018

Related U.S. Application Data

(63) Continuation of application No. 15/210,502, filed on Jul. 14, 2016.

(51) Int. Cl.
*C10M 169/04* (2006.01)
*C10M 161/00* (2006.01)

(52) U.S. Cl.
CPC ..... *C10M 169/04* (2013.01); *C10M 161/00* (2013.01); *C10M 169/044* (2013.01); *C10M 2215/28* (2013.01); *C10M 2217/024* (2013.01); *C10M 2217/028* (2013.01); *C10M 2217/06* (2013.01); *C10N 2220/021* (2013.01); *C10N 2230/02* (2013.01); *C10N 2230/04* (2013.01); *C10N 2230/06* (2013.01); *C10N 2230/10* (2013.01); *C10N 2230/12* (2013.01); *C10N 2230/18* (2013.01); *C10N 2230/36* (2013.01); *C10N 2230/54* (2013.01); *C10N 2240/10* (2013.01); *C10N 2240/102* (2013.01); *C10N 2240/104* (2013.01)

(58) Field of Classification Search
CPC ..... C10M 169/04
USPC ..... 508/291, 221, 232
See application file for complete search history.

(56) References Cited

U.S. PATENT DOCUMENTS

| | | | |
|---|---|---|---|
| 3,219,666 | A | 11/1965 | Norman et al. |
| 3,565,804 | A | 2/1971 | Honnen et al. |
| 3,697,574 | A | 10/1972 | Piasek et al. |
| 3,736,357 | A | 5/1973 | Piasek et al. |
| 4,152,499 | A | 5/1979 | Boerzel et al. |
| 4,234,435 | A | 11/1980 | Meinhardt et al. |
| 4,259,194 | A | 3/1981 | deVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |
| 4,340,689 | A | 7/1982 | Joffrion |
| 4,636,322 | A | 1/1987 | Nalesnik |
| 4,670,515 | A | 6/1987 | Olivier |
| 4,702,850 | A | 10/1987 | Gutierrez et al. |
| 4,867,890 | A | 9/1989 | Colclough et al. |
| 4,943,672 | A | 7/1990 | Hamner et al. |
| 4,948,842 | A | 8/1990 | Olivier |
| 5,334,321 | A | 8/1994 | Harrison et al. |
| 5,627,259 | A | 5/1997 | Thaler et al. |
| 5,633,326 | A | 5/1997 | Patil et al. |
| 5,643,859 | A | 7/1997 | Gutierrez et al. |
| 5,650,381 | A | 7/1997 | Gatto et al. |
| 5,739,355 | A | 4/1998 | Gateau et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,882,505 | A | 3/1999 | Wittenbrink et al. |

(Continued)

FOREIGN PATENT DOCUMENTS

| | | |
|---|---|---|
| JP | 2008127435 | 6/2008 |
| WO | 9400689 | 1/1994 |

OTHER PUBLICATIONS

U.S. Appl. No. 15/210,502, Advisory Action dated Jul. 6, 2017, 3 pages.
U.S. Appl. No. 15/210,502, Final Office Action dated Mar. 15, 2017, 11 pages.
U.S. Appl. No. 15/210,502, Non-Final Office Action dated Oct. 31, 2016, 11 pages.

(Continued)

*Primary Examiner* — Ellen M McAvoy
(74) *Attorney, Agent, or Firm* — Kilpatrick Townsend & Stockton LLP

(57) ABSTRACT

Lubricating oil compositions and methods of their use are provided herein. A lubricating oil composition as described herein includes a major amount of an oil of lubricating viscosity, an amine-functionalized olefin copolymer dispersant viscosity index improver in an amount of from about 1.5 wt. % to 2.0 wt. % based on the weight of the lubricating oil composition, and a dispersant. The amine-functionalized olefin copolymer dispersant viscosity index improver includes a reaction product of an acylated olefin copolymer and a polyamine. The dispersant includes reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

30 Claims, No Drawings

(56) References Cited

U.S. PATENT DOCUMENTS

| | | | | |
|---|---|---|---|---|
| 5,883,057 | A | 3/1999 | Roell, Jr. et al. | |
| 5,936,041 | A | 8/1999 | Diana et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,107,257 | A | 8/2000 | Valcho et al. | |
| 6,165,949 | A | 12/2000 | Berlowitz et al. | |
| 6,180,575 | B1 | 1/2001 | Nipe | |
| 6,187,721 | B1 | 2/2001 | Goldblatt et al. | |
| RE37,363 | E | 9/2001 | Gatto et al. | |
| 6,723,685 | B2 | 4/2004 | Hartley et al. | |
| RE38,929 | E | 1/2006 | Gatto et al. | |
| 7,253,231 | B2 | 8/2007 | Devlin et al. | |
| RE40,595 | E | 12/2008 | Gatto et al. | |
| 7,732,390 | B2 | 6/2010 | Kadkhodayan et al. | |
| 7,897,696 | B2 | 3/2011 | Huang et al. | |
| 8,093,189 | B2 | 1/2012 | Devlin et al. | |
| 8,420,873 | B2 | 4/2013 | Takahashi et al. | |
| 8,703,873 | B2 | 4/2014 | Sauer | |
| 8,865,633 | B2 | 10/2014 | MacPherson et al. | |
| 8,927,469 | B2 * | 1/2015 | Mathur | C10M 159/12 508/291 |
| 9,068,135 | B1 | 6/2015 | Yang et al. | |
| 2004/0259742 | A1 * | 12/2004 | Mishra | C10M 133/58 508/231 |
| 2004/0266630 | A1 | 12/2004 | George et al. | |
| 2008/0182768 | A1 | 7/2008 | Devlin et al. | |
| 2008/0293600 | A1 * | 11/2008 | Goldblatt | C08F 8/32 508/221 |
| 2009/0082234 | A1 | 3/2009 | Devlin et al. | |
| 2010/0160192 | A1 | 6/2010 | Ruhe, Jr. | |
| 2010/0160194 | A1 | 6/2010 | Harrison et al. | |
| 2010/0162981 | A1 | 7/2010 | Adams et al. | |
| 2011/0245120 | A1 | 10/2011 | Bertram et al. | |
| 2011/0287992 | A1 | 11/2011 | Goldblatt et al. | |
| 2012/0101017 | A1 | 4/2012 | Duggal | |
| 2012/0180382 | A1 | 7/2012 | Fang et al. | |
| 2013/0040866 | A1 | 2/2013 | Mathur et al. | |
| 2014/0274834 | A1 | 9/2014 | Sauer et al. | |
| 2018/0016515 | A1 | 1/2018 | Lagona | |

OTHER PUBLICATIONS

Anonymous, Using a Dispersant Viscosity Index Improver to Address Oil Mist Separater (OMS) Cleanliness, Research Disclosure Database No. 583047, 2012, 6 pages.

* cited by examiner

DISPERSANT VISCOSITY INDEX IMPROVER-CONTAINING LUBRICANT COMPOSITIONS AND METHODS OF USE THEREOF

CROSS-REFERENCE TO RELATED APPLICATION

This application is a continuation of U.S. patent application Ser. No. 15/210,502, filed Jul. 14, 2016, which is incorporated herein by reference in its entirety.

BACKGROUND

Oil mist separators (OMS) are used in engines to separate oil and soot from blow-by gases coming from the crankcase. The unclean blow-by gases enter through the top of the OMS, which functions as a centrifuge to separate the oil from the air or gas, thus cleaning the air or gas. The OMS contains disc stacks, which consists of closely spaced conical discs that spin. The disc stacks are rotated by a turbine on the bottom of the OMS that is driven by oil from the oil gallery. Blow-by gases are forced through the gaps of the rotating discs.

Oil droplets, soot, and aqueous acidic combustion condensate settle onto the upper surface of the lower cone due to the high centrifugal acceleration in each gap. The disc sacks spin the liquid film to the outer annulus until the liquid is spun off the disc stack and onto the outer housing. The liquid drains down the wall to the oil sump and the clean blow-by gas travels up the outer annulus and out of the clean blow-by exit. Additional oil travels up the inside of the rotating shaft to lubricate the bearing at the top of the oil mist separator. The oil wetting the bearing then drains back into the oil mist separator where it is separated from the blow-by gas and drained back into the oil sump. The OMS may become clogged, for example with soot and/or sludge, from engine oil exhaust. Keeping the OMS clean may be key to preventing clogging and preventing failure of drainage channel in engines such as heavy duty diesel engines.

Many different chemicals may contribute to the formation of and levels of soot or sludge in an engine crankcase and OMS. New additive compositions and lubricating oil compositions capable of controlling soot concentrations and sludge build up.

SUMMARY AND TERMS

Provided herein are lubricating oil compositions and methods of their use. A lubricating oil composition as described herein includes a major amount of an oil of lubricating viscosity, an amine-functionalized olefin copolymer dispersant viscosity index improver in an amount of from about 1.5 wt. % to about 2.0 wt. % based on the weight of the lubricating oil composition, and a dispersant. The amine-functionalized olefin copolymer dispersant viscosity index improver includes a reaction product of an acylated olefin copolymer and a polyamine. The dispersant includes a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride group are attached directly to an aromatic ring, and/or (D) a non-aromatic dicarboxylic acid or anhydride having a number average molecular weight of less than about 500. In a preferred embodiment, the hydrocarbyl dicarboxylic acid or anhydride comprises a polyisobutenyl succinic acid or anhydride. The dispersant can optionally be a reaction product of A and B, post-treated with both C and D.

The amine-functionalized olefin copolymer dispersant viscosity index improver can include an olefin copolymer having grafted thereon from 0.3 to 0.75 carboxylic groups per 1000 number average molecular weight units of olefin copolymer. Optionally, the olefin copolymer has a number average molecular weight of between about 40,000 and about 150,000. The olefin copolymer is optionally a copolymer of ethylene and one or more $C_3$-$C_{23}$ alpha-olefins. The amine-functionalized olefin copolymer dispersant viscosity index improver can be present in an amount of about 1.8 wt. % based on the weight of the lubricating oil composition.

The dispersant in the lubricating oil composition can be present in an amount of from about 2 wt. % to about 10 wt. % (e.g., from about 5 wt. % to about 5.5 wt. %). Optionally, component (A) includes a polyalkenyl-substituted succinic acid or anhydride. Optionally, component (C) includes 1,8-naphthalic anhydride. Component (D) optionally includes maleic anhydride. Optionally, from about 0.25 to 1.5 moles of component (C) is reacted per mole of component (B). Optionally, from about 0.25 to 1.5 moles of component (D) is reacted per mole of component (B).

The oil of lubricating viscosity can comprise a Group II oil. Optionally, the oil of lubricating viscosity can comprise a mixture of a Group II oil and a Group III oil. The oil of lubricating viscosity can meet the specification of a SAE 5W-30 engine oil, a SAE 10W-30 engine oil, a SAE 10W-40 engine oil, or a SAE 15W-40 engine oil.

The lubricating oil composition can further include a detergent. The detergent can comprise, for example, a metal-containing detergent (e.g., a calcium-containing detergent or a magnesium-containing detergent). Optionally, the metal-containing detergent is selected from the group consisting of a neutral calcium sulfonate, an overbased calcium sulfonate, a neutral calcium phenate, an overbased calcium phenate, a neutral magnesium sulfonate, an overbased magnesium sulfonate, a neutral magnesium phenate, an overbased magnesium phenate, and mixtures thereof.

Optionally, the lubricating oil composition can further include an additional dispersant (e.g., one or more polyalkenyl succinimide dispersants), an anti-wear agent, an antioxidant, an antifoam agent, a friction modifier, a pour-point depressant, a viscosity modifier, or a mixture of these. Optionally, the lubricating oil composition is a heavy duty engine oil composition.

Also provided herein are methods of lubricating an engine. The methods of lubricating an engine comprise supplying to an engine the lubricating oil composition as described herein.

Additionally provided herein are methods of controlling soot induced viscosity increase in an engine lubricant. The methods of controlling soot induced viscosity increase in an engine lubricant comprise lubricating an engine with the lubricating oil composition as described herein.

The methods of using the lubricating oil composition also include methods of reducing oil mist separator filter plugging in an engine. The methods of reducing oil mist separator filter plugging in an engine comprise lubricating an engine with the lubricating oil composition as described herein.

Methods of reducing or preventing sludge formation in an oil mist separator are also provided herein. The methods of reducing or preventing sludge formation in an oil mist separator comprise lubricating an engine with the lubricating oil composition as described herein.

Additionally provided herein are methods of controlling wear during operation of an engine. The methods include lubricating an engine with the lubricating oil composition as described herein and operating the engine.

Further provided herein are additive compositions. An additive composition as described herein includes an amine-functionalized olefin copolymer dispersant viscosity index improver comprising a reaction product of an acylated olefin copolymer and a polyamine in an amount of from about 8 wt. % to about 12 wt. % based on the weight of the additive composition and a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

In a preferred embodiment, the hydrocarbyl dicarboxylic acid or anhydride comprises a polyisobutenyl succinic acid or anhydride.

The amine-functionalized olefin copolymer dispersant viscosity index improver is optionally present in an amount of from about 10 wt. % to about 11 wt. % based on the weight of the additive composition. Optionally, the weight ratio of the dispersant to the amine-functionalized olefin copolymer dispersant viscosity index improver is from about 1.5:1 to about 3:1 (e.g., from about 2:1 to about 3:1). The dispersant is optionally present in an amount of from about 10 wt. % to about 20 wt. % (e.g., from about 10 wt. % to about 12 wt. %).

The details of one or more embodiments are set forth in the description below. Other features, objects, and advantages will be apparent from the description and from the claims.

The following definitions of terms are provided to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," and "motor oil concentrate" are considered synonymous, fully interchangeable terminology referring to the portion of the lubricating oil composition excluding the major amount of base oil stock mixture. The additive package may or may not include a viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., the salts may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR is greater than one. Such salts (wherein the MR is greater than one) are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, either term refers to a group having a carbon atom directly attached to the remainder of the molecule and having predominantly hydrocarbon character. Examples of hydrocarbyl groups include:

(a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-groups which, in the context of this disclosure, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain other than carbon in a ring or chain otherwise composed of carbon atoms. Heteroatoms may include sulfur, oxygen, and nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "soluble," "oil-soluble," or "dispersible" as used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896, ASTM D4739, or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to, heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Particularly preferred types of engines for which the lubricant compositions of the present invention may be used are heavy duty diesel (HDD) engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubricated coating, a phosphorus-containing coating, a molybdenum-containing coating, a graphite coating, a nano-particle-containing coating, and/or mixtures thereof. The aluminum-alloy may include aluminum silicates, aluminum oxides, or other ceramic materials. In one embodiment, the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds, such with ceramic-like materials.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt. % or less, about 0.8 wt. % or less, about 0.5 wt. % or less, about 0.3 wt. % or less, or about 0.2 wt. % or less. In one embodiment, the sulfur content may be in the range of from about 0.001 wt. % to about 0.5 wt. % or from about 0.01 wt. % to about 0.3 wt. %. The phosphorus content may be about 0.2 wt. % or less, about 0.1 wt. % or less, about 0.085 wt. % or less, about 0.08 wt. % or less, about 0.06 wt. % or less, about 0.055 wt. % or less, or about 0.05 wt. % or less. In one embodiment, the phosphorus content may be from about 50 ppm to about 1000 ppm or from about 325 ppm to about 850 ppm. The total sulfated ash content may be about 2 wt. % or less, about 1.5 wt. % or less, about 1.1 wt. % or less, about 1 wt. % or less, about 0.8 wt. % or less, or about 0.5 wt. % or less. In one embodiment, the sulfated ash content may be from about 0.05 wt. % to about 0.9 wt. % or from about 0.1 wt. % or about 0.2 wt. % to about 0.45 wt. %. In another embodiment, the sulfur content may be about 0.4 wt. % or less, the phosphorus content may be about 0.08 wt. % or less, and the sulfated ash is about 1 wt. % or less. In yet another embodiment, the sulfur content may be about 0.3 wt. % or less, the phosphorus content is about 0.05 wt. % or less, and the sulfated ash may be about 0.8 wt. % or less.

In one embodiment, the lubricating oil composition is an engine oil, wherein the lubricating oil composition may have (i) a sulfur content of about 0.5 wt. % or less, (ii) a phosphorus content of about 0.1 wt. % or less, and (iii) a sulfated ash content of about 1.5 wt. % or less.

In one embodiment, the lubricating oil composition is suitable for a 2-stroke or a 4-stroke marine diesel internal combustion engine. In one embodiment, the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur). Low speed diesel typically refers to marine engines, medium speed diesel typically refers to locomotives, and high speed diesel typically refers to highway vehicles. The lubricating oil composition may be suitable for only one of these types or all.

Further, lubricants of the present description may be suitable to meet one or more industry specification requirements, such as ILSAC GF-3, GF-4, GF-5, GF-6, CK-4, FA-4, CJ-4, CI-4 Plus, CI-4, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, 508.00, 509.00, BMW Longlife-04, Porsche C30, Peugeot Citroen Automobiles B71 2290, B71 2296, B71 2297, B71 2300, B71 2302, B71 2312, B71 2007, B71 2008, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for heavy duty diesel engine applications, the amount of phosphorus in the finished fluid is 1200 ppm or less, 1000 ppm or less, or 800 ppm or less.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Described herein are lubricating oil compositions for use in engines, including spark ignition engines and compression-ignition internal combustion engines. Exemplary engines include diesel engines (e.g., heavy duty diesel engines), marine engines, rotary engines, turbine engines, locomotive engines propulsion engines, aviation piston engines, stationary power generation engines, continuous power generation engines, and engines comprising silver parts. The lubricating oil compositions described herein are suitable for engine applications that provide improvements in antioxidancy, antiwear performance, rust inhibition, fuel economy, water tolerance, air entrainment, seal protection, and foam reducing properties.

I. Lubricating Oil Compositions

The lubricating oil compositions described herein include a major amount of an oil of lubricating viscosity, an amine-functionalized olefin copolymer dispersant viscosity index improver comprising a reaction product of an acylated olefin copolymer and a polyamine in an amount of from about 1.5 wt. % to 2.0 wt. % based on the weight of the lubricating oil composition, and a dispersant comprising a reaction product of components (A) a hydrocarbyl-dicarboxylic acid or anhydride having a number average molecular weight of from about 500 to 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500. Components A-D used to make this dispersant are described in greater detail below. One such dispersant is described, for example, in JP2008-127435. A dispersant including a reaction product of components A-D is described in U.S. Pat. No. 8,927,469.

In a preferred embodiment, the hydrocarbyl dicarboxylic acid or anhydride comprises a polyisobutenyl succinic acid or anhydride.

Base Oil

As described above, the lubricating oil compositions include a major amount of an oil of lubricating viscosity, which are also referred to herein as base oils. The base oil for use in the lubricating oil compositions as described herein can be selected from any of the base oils in Groups I-V, as specified in the American Petroleum Institute (API) Base Oil Interchangeability Guidelines. Such base oil groups are as follows:

TABLE 1

| Base Oil Group[1] | Sulfur (wt. %) | | Saturates (wt. %) | Viscosity Index |
|---|---|---|---|---|
| Group I | >0.03 | And/or | <90 | 80 to 120 |
| Group II | ≤0.03 | And | ≥90 | 80 to 120 |
| Group III | ≤0.03 | And | ≥90 | ≥120 |

TABLE 1-continued

| Base Oil Group[1] | Sulfur (wt. %) | Saturates (wt. %) | Viscosity Index |
|---|---|---|---|
| Group IV | all polyalphaolefins (PAOs) | | |
| Group V | all others not included in Groups I-IV | | |

[1]Groups I-III are mineral oil base stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. Although Group III base oils are derived from mineral oil, they undergo rigorous processing that causes their physical properties to be similar to some true synthetics, such as PAOs.

The base oil can be a mineral oil, i.e., a Group I, Group II, or Group III base oil. The base oil can optionally be a combination of base oils of different groups, i.e., a mixture of Group I, Group II, Group III, Group IV, and/or Group V. In some examples, the base oil can be a Group II base oil. In other examples, the base oil can be a mixture of a Group II base oil and a Group III base oil.

Optionally, the base oils suitable for use in formulating lubricating oil compositions can include synthetic oils, animal oils, vegetable oils, mineral oils, or mixtures thereof. For example, animal oils and vegetable oils (e.g., lard oil and castor oil), as well as mineral lubricating oils such as liquid petroleum oils and solvent treated or acid-treated mineral lubricating oils of the paraffinic, naphthenic or mixed paraffinic-naphthenic types can be used. Oils derived from coal or shale can also be suitable.

Suitable synthetic base oils can include, for example, alkyl esters of dicarboxylic acids, polyglycols and alcohols, poly-alpha-olefins (e.g., polybutenes), alkyl benzenes, organic esters of phosphoric acids, and polysilicone oils. Synthetic oils can include hydrocarbon oils, such as polymerized, oligomerized, or interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides, and derivatives, analogs, and homologs thereof and the like. Alkylene oxide polymers and interpolymers and derivatives thereof can optionally be used as the synthetic oils. The alkylene oxide polymers and interpolymers useful as base oils as descried herein can include such alkylene oxide polymers and interpolymers in which the terminal hydroxyl groups have been modified by esterification, etherification, etc. Exemplary oils in the alkylene oxide polymers and interpolymers class include oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, such as, for example, the acetic acid esters, mixed $C_3$-$C_8$ fatty acid esters, or the $C_{13}$ oxo-acid diester of tetraethylene glycol.

Another class of synthetic oils that can be used as the base oil includes esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) reacted with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils can also include those made from $C_5$ to $C_{12}$ monocarboxylic acids and polyols and polyol ethers such as neopentyl glycol, trimethylol propane, pentaerythritol, dipentaerythritol, tripentaerythritol, etc.

The base oil can contain a minor or major amount of a poly-alpha-olefin (PAO). Typically, the poly-alpha-olefins are derived from monomers having from about 4 to about 30, from about 4 to about 20, or from about 6 to about 16 carbon atoms. Examples of useful PAOs include those derived from octene, decene, mixtures thereof, and the like. PAOs can have a viscosity of from about 2 cSt to about 100 cSt at 100° C., from about 3 cSt to about 12 cSt at 100° C., from about 4 cSt to about 8 cSt at 100° C., or from about 60 cSt to about 100 cSt at 100° C. Examples of PAOs include 4 cSt at 100° C. poly-alpha-olefins, 6 cSt at 100° C. poly-alpha-olefins, 60 cSt at 100° C. poly-alpha-olefins, 100 cSt at 100° C. poly-alpha-olefins, and mixtures thereof. Mixtures of mineral oil with the foregoing poly-alpha-olefins can be used.

The base oil can be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons can be hydroisomerized using processes disclosed in U.S. Pat. No. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949, all of which are incorporated herein by reference.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation, or ester oil obtained directly from an esterification process and used without further treatment would be an unrefined oil. Refined oils are similar to the unrefined oils except refined oils have been further treated in one or more purification steps to improve one or more properties. Such purification techniques are known to those skilled in the art and include, for example, solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to the removal of spent additives, contaminants, and oil breakdown products.

The base oil can have a viscosity of about 2 cSt to about 100 cSt at 100° C. In some examples, the base oil can have a viscosity of about 2 cSt to about 15 cSt at 100° C. (e.g., from about 2 cSt to about 10 cSt at 100° C.). In some examples, an oil derived from a gas-to-liquid process can be used as the base oil.

The Society of Automotive Engineers (SAE) classification system, SAE J300, defines engine oil grade viscosity specifications. Single grades are designated as SAE 20, 30, 40, 50, and 60 grade, and are defined by a low shear rate kinematic viscosity range at 100° C. (ASTM D445), as well as a minimum high shear rate viscosity at 150° C. (such as ASTM D4683, CEC L-36-A-90, or ASTM D5481). Engine oils designated as SAE 0W through 25W have been classified according to their low temperature cranking viscosities (ASTM D5293), low temperature pumping viscosities (ASTM4684), and a minimum kinematic viscosity at 100° C. Multigrade oils meet both the high and low temperature viscosity requirements indicated in their nomenclature. For example, an engine oil designated as SAE 5W-30 possesses the viscometric characteristics of SAE 30 motor oils as well as the low temperature viscometric qualities of SAE 5W.

Optionally, the base oil is selected such that the combination of the base oil and additives meets the requirements of SAE 5W, SAE 10W, SAE 15W, SAE 20W, SAE 25W and SAE 40W grades (e.g., SAE 5W-30, SAE 10W, SAE 10W-20, SAE 10W-30, SAE 10W-40, and/or SAE 10W-50 and/or SAE 15W, SAE 15W-20, SAE 15W-30, SAE 15W-40, and/or SAE 15W-50) and the like and mixtures thereof. The base oil can be present in the engine lubricant composition in an amount ranging from about 50 wt. % to about 95 wt. % based on a total weight of the lubricant composition. For example, the base oil can be present in the lubricating oil composition in an amount ranging from about 55 wt. % to about 90 wt. %, from about 60 wt. % to about 85 wt. %, or from about 65 wt. % to about 80 wt. %.

Dispersant Viscosity Index Improver

The lubricating oil composition described herein also contains an amine-functionalized olefin copolymer dispersant viscosity index improver. The dispersant viscosity index improver includes a reaction product of an acylated olefin copolymer and a polyamine.

In an embodiment, polymers for use herein can include copolymers of ethylene and one or more $C_3$ to $C_{23}$ alpha-olefins. For example, the polymers can include copolymers of ethylene and propylene. Other alpha-olefins suitable in place of propylene to form the copolymer or to be used in combination with ethylene and propylene to form a terpolymer include 1-butene, 1-pentene, 1-hexene, 1-octene and styrene; $\alpha,\omega$-diolefins such as 1,5-hexadiene, 1,6-heptadiene, 1,7-octadiene; branched chain alpha-olefins such as 4-methylbutene-1,5-methylpentene-1 and 6-methylheptene-1; and mixtures thereof.

More complex polymer substrates, often designated as interpolymers, can be prepared using a third component in preparing the dispersant used in the oil to lubricate cooled EGR engines. The third component generally used to prepare an interpolymer substrate includes a polyene monomer selected from non-conjugated dienes and trienes. The non-conjugated diene component is one having from 5 to 14 carbon atoms in the chain. In some examples, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norborene, 1,5-heptadiene, and 1,6-octadiene. A mixture of more than one diene can be used in the preparation of the interpolymer. In some examples, a non-conjugated diene for preparing a terpolymer or interpolymer substrate is 1,4-hexadiene.

The triene component will have at least two non-conjugated double bonds, and up to about 30 carbon atoms in the chain. Typical trienes useful in preparing the interpolymer include 1-isopropylidene-3α,4,7,7α-tetrahydroindene, 1-isopropylidene dicyclopentadiene, dihydro-isodicyclopentadiene, and 2-(2-methylene-4-methyl-3-pentenyl) [2.2.1] bicyclo-5-heptene.

Ethylene-propylene or higher α-olefin copolymers can include from about 15 to 80 mole percent ethylene and from about 85 to 20 mole percent $C_3$ to $C_{23}$ α-olefin with the mole ratios being from about 35 to 75 mole percent ethylene and from about 65 to 25 mole percent of a $C_3$ to $C_{23}$ alpha-olefin. In some examples, the proportions are from 50 to 70 mole percent ethylene and 50 to 30 mole percent $C_3$ to $C_{23}$ α-olefin. In other examples, the proportions are from 55 to 65 mole percent ethylene and 45 to 35 mole percent $C_3$ to $C_{23}$ α-olefin.

Terpolymer variations of the foregoing polymers can contain from about 0.1 to 10 mole percent of a non-conjugated diene or triene.

Also useful as polymers for the dispersant viscosity index improver include polymethacrylates, ethylene/propylene copolymers, polyisoprene or saturated polyisoprene, and polyisoprene/saturated polyisoprene copolymers.

The olefin copolymer, e.g., the ethylene copolymer or terpolymer, can be an oil-soluble, linear or branched polymer having a number average molecular weight from about 5,000 to 150,000 as determined by gel permeation chromatography and universal calibration standardization. For example, the number average molecular weight of the olefin copolymer can be from about 7,000 to about 110,000 or from about 40,000 to about 150,000.

The terms polymer and copolymer are used generically to encompass ethylene copolymers, terpolymers, or interpolymers. These materials can contain minor amounts of other olefinic monomers as long as the basic characteristics of the ethylene copolymers are not materially changed.

The polymerization reaction used to form the ethylene-olefin copolymer substrate is generally carried out in the presence of a conventional Ziegler-Natta or metallocene catalyst system. The polymerization medium can include solution-, slurry-, or gas-phase processes, as known to those skilled in the art. When solution polymerization is employed, the solvent can be any suitable inert hydrocarbon solvent that is liquid under reaction conditions for polymerization of alpha-olefins. Examples of suitable hydrocarbon solvents include straight chain paraffins having from 5 to 8 carbon atoms, such as hexane. Aromatic hydrocarbons, preferably aromatic hydrocarbons having a single benzene nucleus (such as benzene, toluene and the like) and saturated cyclic hydrocarbons having boiling point ranges approximating those of the straight chain paraffinic hydrocarbons and aromatic hydrocarbons described above are particularly suitable. The solvent selected can be a mixture of one or more of the foregoing hydrocarbons. When slurry polymerization is employed, the liquid phase for polymerization can be, for example, liquid propylene. It is desirable that the polymerization medium be free of substances that will interfere with the catalyst components.

An ethylenically unsaturated carboxylic acid material is next grafted onto the prescribed polymer backbone to form an acylated ethylene copolymer. These carboxylic reactants which are suitable for grafting onto the ethylene copolymer contain at least one ethylenic bond and at least one, preferably two, carboxylic acid or its anhydride or a polar group which is convertible into the carboxyl groups by oxidation or hydrolysis. The carboxylic reactants can include acrylic, methacrylic, cinnamic, crotonic, maleic, fumaric and/or itaconic reactants. Alternatively, the carboxylic reactants can be selected from the group consisting of maleic acid, fumaric acid, maleic anhydride, or a mixture of two or more of these. Maleic anhydride and derivatives thereof have advantages of commercial availability and ease of reaction. In the case of unsaturated ethylene copolymers or terpolymers, itaconic acid or its anhydride are useful due to its reduced tendency to form a cross-linked structure during the free-radical grafting process.

The ethylenically unsaturated carboxylic acid materials typically can provide one or two carboxylic groups per mole of reactant to the grafted polymer. For example, methyl methacrylate can provide one carboxylic group per molecule to the grafted polymer while maleic anhydride can provide two carboxylic groups per molecule to the grafted polymer.

In some examples, the carboxylic reactant is grafted onto the prescribed polymer backbone in an amount to provide 0.15 to 1.0 carboxylic groups per 1000 number average molecular weight units of the polymer backbone. In some examples, the olefin copolymer has grafted thereon from 0.3 to 0.75 carboxylic groups per 1000 number average molecular weight units of olefin copolymer, preferably 0.3 to 0.5 carboxylic groups per 1000 number average molecular weight. For example, a copolymer substrate with an Mn of 20,000 can be grafted with 6 to 10 carboxylic groups per polymer chain or 3 to 5 moles of maleic anhydride per mole of polymer. A copolymer with an Mn of 100,000 can be grafted with 30 to 50 carboxylic groups per polymer chain or 15 to 25 moles of maleic anhydride per polymer chain. The minimum level of functionality is the level needed to achieve the minimum satisfactory dispersancy performance in lubricated cooled EGR engines.

The grafting reaction to form the acylated olefin copolymers is generally carried out with the aid of a free-radical initiator either in solution or in bulk, as in an extruder or intensive mixing device. When the polymerization is carried out in hexane solution, it is economically convenient, but not required, to carry out the grafting reaction in hexane as described in U.S. Pat. Nos. 4,340,689; 4,670,515; and 4,948,842, incorporated herein by reference. The resulting polymer intermediate is characterized by having carboxylic acid acylating functionality randomly within its structure.

The polyamine compound for reacting with the copolymer can include N-arylphenylenediamines, aminothiazoles, aminocarbazoles, aminoindoles, aminopyrroles, amino-indazolinones, aminomercaptotriazoles, aminoperimidines, aminoalkyl imidazoles, and aminoalkyl morpholines. Exemplary polyamine compounds are further described below.

In some examples, the polyamine compound can be an N-arylphenylenediamine represented by the formula:

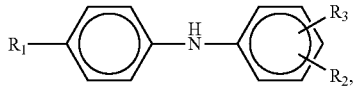

wherein $R^1$ is hydrogen, NH-aryl, —NH-arylalkyl, —NH-alkyl, or a branched or straight chain radical having from 4 to 24 carbon atoms that can be alkyl, alkenyl, alkoxyl, aralkyl, alkaryl, hydroxyalkyl or aminoalkyl; $R^2$ is —$NH_2$, $CH_2$—$(CH_2)_n$—$NH_2$, $CH_2$-aryl-$NH_2$, in which n has a value from 1 to 10; and $R^3$ can be hydrogen, alkyl, alkenyl, alkoxyl, aralkyl, alkaryl having from 4 to 24 carbon atoms;

In some examples, the polyamine compound be an aminothiazole. Exemplary aminothiazole compounds include aminothiazole, aminobenzothiazole, aminobenzo-thiadiazole, and aminoalkylthiazole.

Optionally, the polyamine compound can be an aminocarbazole represented by the formula:

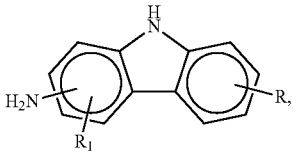

wherein R and $R^1$ represent hydrogen or an alkyl, alkenyl or alkoxyl radical having from 1 to 14 carbon atoms.

The polyamine compound can also be an aminoindole represented by the formula:

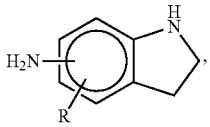

wherein R represents hydrogen or an alkyl radical having from 1 to 14 carbon atoms.

In addition, the polyamine compound can be an aminopyrrole represented by the formula:

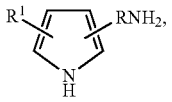

wherein R is a divalent alkylene radical having 2-6 carbon atoms and $R^1$ is hydrogen or an alkyl radical having from 1 to 14 carbon atoms.

Optionally, the polyamine compound can be an aminoindazolinone represented by the formula:

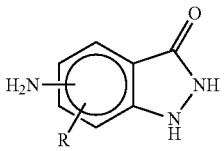

wherein R is hydrogen or an alkyl radical having from 1 to 14 carbon atoms.

The polyamine compound can optionally be an aminomercaptotriazole represented by the formula:

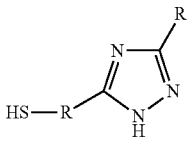

wherein R can be absent or is a $C_1$-$C_{10}$ linear or branched hydrocarbon selected from the group consisting of alkyl, alkenyl, arylalkyl, or aryl.

The polyamine compound can be an aminoperimidine represented by the formula:

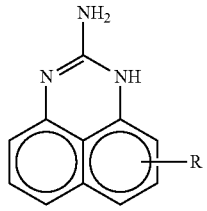

wherein R represents hydrogen or an alkyl or alkoxy radical having from 1 to 14 carbon atoms.

In some examples, the polyamine compound can be an aminoalkyl imidazole compound. For example, the polyamine can be 1-(2-aminoethyl) imidazole or 1-(3-aminopropyl) imidazole.

In other examples, the polyamine compound can be an aminoalkyl morpholine compound, such as 4-(3-aminopropyl) morpholine.

The dispersant viscosity index improver formed from the reaction product of an acylated olefin copolymer and a polyamine, as described above, can be included in the lubricating oil composition in an amount of from about 1.5 wt. % to 2.0 wt. % based on the weight of the lubricating oil composition. For example, the dispersant viscosity index improver can be included in the lubricating oil composition in an amount of about 1.5 wt. %, 1.6 wt. %, 1.7 wt. %, 1.8 wt. %, 1.9 wt. %, or 2.0 wt. %.

Functionalized Dispersant

A dispersant is also included in the lubricating oil compositions described herein. The dispersant is a functionalized dispersant that includes a reaction product of the following components: (A) a hydrocarbyl-dicarboxylic acid or anhydride having a number average molecular weight of from about 500 to 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

In one embodiment, the hydrocarbyl dicarboxylic acid or anhydride comprises a polyisobutenyl succinic acid or anhydride.

Component A

The hydrocarbyl moiety of the hydrocarbyl-dicarboxylic acid or anhydride of Component A can be derived from butene polymers, for example, polymers of isobutylene. Suitable polyisobutenes for use herein include those formed from polyisobutylene or highly reactive polyisobutylene having at least about 60%, such as about 70% to about 90% and above, terminal vinylidene content. Suitable polyisobutenes can include those prepared using $BF_3$ catalysts. The average number molecular weight of the polyalkenyl substituent can vary over a wide range, for example from about 100 to about 5000 (e.g., from about 500 to about 5000 or from about 1000 to about 2500), as determined by GPC using polystyrene as a calibration reference as described above.

The dicarboxylic acid or anhydride of Component A can be or can be prepared from maleic anhydride or from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, succinic acid, and the like, including the corresponding acid halides and lower aliphatic esters. A suitable dicarboxylic anhydride is maleic anhydride. A mole ratio of maleic anhydride to hydrocarbyl moiety in a reaction mixture used to make Component A may vary widely. Accordingly, the mole ratio may vary from about 5:1 to about 1:5, for example from about 3:1 to about 1:3. Optionally, the maleic anhydride can be used in stoichiometric excess to force the reaction to completion. The unreacted maleic anhydride can be removed by vacuum distillation. Optionally, component (A) includes a polyalkenyl-substituted succinic acid or anhydride.

Component B

Component B for use in preparing the functionalized dispersant can be a polyamine. The polyamine Component B may be a polyalkylene polyamine. Non-limiting exemplary polyamines can include ethylene diamine, propane diamine, butane diamine, aminoguanidine bicarbonate (AGBC), diethylene triamine (DETA), triethylene tetramine (TETA), tetraethylene pentamine (TEPA), pentaethylene hexamine (PEHA), and heavy polyamines. A heavy polyamine can comprise a mixture of polyalkylenepolyamines having small amounts of lower polyamine oligomers, such as TEPA and PEHA, but primarily oligomers having seven or more nitrogen atoms, two or more primary amines per molecule, and more extensive branching than conventional polyamine mixtures. Additional non-limiting polyamines that can be used to prepare the hydrocarbyl-substituted succinimide dispersant are disclosed in U.S. Pat. No. 6,548,458, incorporated herein by reference. Preferably, the polyamines used as Component B are selected from the group of triethylene tetramine, tetraethylene polyamine, heavy amine bottoms, and combinations thereof. In one preferred embodiment, the polyamine can be selected from tetraethylene pentamine (TEPA).

In an embodiment, the functionalized dispersant may be derived from compounds represented by the formula:

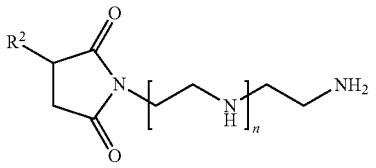

wherein n represents 0 or an integer of from 1 to 5, and $R^2$ is a hydrocarbyl substituent as defined above.

In some examples, n is 3 and $R^2$ is a polyisobutenyl substituent, such as that derived from polyisobutylenes having at least about 60%, such as about 70% to about 90% and above, terminal vinylidene content. Optionally, the compounds may be the reaction product of a hydrocarbyl-substituted succinic anhydride, such as a polyisobutenyl succinic anhydride (PIBSA), and a polyamine, for example tetraethylene pentamine (TEPA).

The functionalized dispersant represented by the formula shown above may have a molar ratio of (A) polyisobutenyl-substituted succinic anhydride to (B) polyamine in the range of about 1:1 to 10:1, preferably, 1:1 to 5:1, or 4:3 to 3:1 or 4:3 to 2:1 in the compound. A particularly useful dispersant contains polyisobutenyl group of the polyisobutenyl-substituted succinic anhydride having a number average molecular weight (Mn) in the range of from about 500 to 5000 as determined by GPC using polystyrene as a calibration reference and a (B) polyamine having a general formula $H_2N(CH_2)m\text{-}[NH(CH_2)_m]_n\text{—}NH_2$, wherein m is in the range from 2 to 4 and n is in the range of from 1 to 2. Preferably, A is polyisobutylene succinic anhydride (PIBSA). The PIBSA or A may have an average of from about 1.0 to about 2.0 succinic acid moieties per polymer.

Examples of N-substituted long chain alkenyl succinimides of the formula shown above include polyisobutylene succinimide with a number average molecular weight of the polyisobutylene substituent in the range of from about 350 to about 50,000, or to about 5,000, or to about 3,000. Succinimide dispersants and their preparation are disclosed, for instance in U.S. Pat. Nos. 7,897,696 or 4,234,435. The polyolefin may be prepared from polymerizable monomers containing from about 2 to about 16, from about 2 to about 8, or from about 2 to about 6 carbon atoms.

In an embodiment, the functionalized dispersant is derived from polyisobutylene (PIB) with a number average molecular weight in the range from about 350 to about 50,000, or to about 5000, or to about 3000. In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000 is suitable for use in embodiments of the present disclosure. Conventional PIB typically has less than 50 mol %, less than 40 mol %, less than 30 mol %, less than 20 mol %, or less than 10 mol % content of terminal double bonds. The % actives of the alkenyl or alkyl succinic anhydride can be determined using a chromatographic technique, as described, for example, in columns 5 and 6 of U.S. Pat. No. 5,334,321.

An HR-PIB having a number average molecular weight ranging from about 900 to about 3000 may be suitable. Such an HR-PIB is commercially available, or can be synthesized by the polymerization of isobutene in the presence of a non-chlorinated catalyst such as boron trifluoride, as described in U.S. Pat. No. 4,152,499 to Boerzel et al. and U.S. Pat. No. 5,739,355 to Gateau et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

Component C

Component C is an aromatic carboxylic acid, an aromatic polycarboxylic acid, or an aromatic anhydride wherein the carboxylic acid or anhydride group(s) are attached directly to an aromatic ring. Such carboxyl-containing aromatic compound can be selected from 1,8-naphthalic acid or anhydride and 1,2-naphthalenedicarboxylic acid or anhydride; 2,3-naphthalenedicarboxylic acid or anhydride; naphthalene-1,4-dicarboxylic acid; naphthalene-2,6-dicarboxylic acid; phthalic anhydride; pyromellitic anhydride; 1,2,4-benzene tricarboxylic acid anhydride; diphenic acid or anhydride; 2,3-pyridine dicarboxylic acid or anhydride; 3,4-pyridine dicarboxylic acid or anhydride; 1,4,5,8-naphthalenetetracarboxylic acid or anhydride; perylene-3,4,9,10-tetracarboxylic anhydride; pyrene dicarboxylic acid or anhydride; and the like. The moles of this post-treatment component reacted per mole of the polyamine may range from about 0.1:1 to about 2:1. A typical molar ratio of Component C to Component B in the reaction mixture can range from about 0.2:1 to about 2.0:1. Another molar ratio of Component C to Component B that can be used can range from 0.25:1 to about 1.5:1. Component C may be reacted with the other components at a temperature ranging from about 140° to about 180° C.

Component D

Component D is a non-aromatic dicarboxylic acid or anhydride. The non-aromatic dicarboxylic acid or anhydride may have a number average molecular weight of less than 500. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

Component D is reacted on a molar ratio with Component B ranging from about 0.1 to about 2.5 moles of Component D per mole of Component B reacted. Typically, the amount of Component D used is relative to the number of secondary amino groups in Component B. Accordingly, from about 0.2 to about 2.0 moles of Component D per secondary amino group in Component B can be reacted with the other components to provide the dispersant according to embodiments of the disclosure. Another molar ratio of Component D to Component B that can be used can range from 0.25:1 to about 1.5:1 moles of Component D per mole of Component B. Component D can be reacted with the other components at a temperature ranging from about 140° to about 180° C.

The post-treatment step may be carried out upon completion of the reaction of the olefin copolymer with succinic anhydride and at least one polyamine.

The TBN of a suitable functionalized dispersant of the formula above may be from about 10 to about 65 on an oil-free basis, which is comparable to about 5 to about 30 TBN if measured on a dispersant sample containing about 50% diluent oil.

The lubricating oil composition can contain from about 0.5 wt. % to about 10.0 wt. % of the functionalized dispersant described above based on a total weight of the lubricating oil composition. Optionally, the functionalized dispersant can be present in an amount of from about 1 wt. % to about 9 wt. %, from about 2 wt. % to about 7 wt. %, from about 2.5 wt. % to about 5 wt. %, or from about 5.0 wt. % to about 5.5 wt. %, based on the total weight of the lubricating oil composition. For example, the dispersant can be present in the lubricating oil composition in an amount of about 0.5 wt. %, about 1 wt. %, about 1.5 wt. %, about 2 wt. %, about 2.5 wt. %, about 3 wt. %, about 3.5 wt. %, about 4 wt. %, about 4.5 wt. %, about 5 wt. %, about 5.5 wt. %, about 6 wt. %, about 6.5 wt. %, about 7 wt. %, about 7.5 wt. %, about 8 wt. %, about 8.5 wt. %, about 9 wt. %, about 9.5 wt. %, or about 10 wt. %.

Additional Components

In addition to the base oil, the dispersant viscosity index improver, and the functionalized dispersant, the lubricant composition can optionally include other components. Such optional components include, but are not limited to, detergents (e.g., metal detergents), friction modifiers, additional dispersants, antiwear agents, antifoam agents, antioxidants, viscosity modifiers, pour point depressants, corrosion inhibitors and the like.

Detergents

The lubricating oil compositions can further include a detergent. Optionally, the detergent is a metal-containing detergent. Metal-containing detergents that may be used with the dispersant reaction product described above generally include a polar head with a long hydrophobic tail, where the polar head comprises a metal salt of an acidic organic compound. The salts may contain a substantially stoichiometric amount of the metal, in which case they are usually described as normal or neutral salts. Such normal or neutral salts typically have a total base number or TBN (as measured by ASTM D2896) of from about 0 to less than about 150. Large amounts of a metal base may be included by reacting an excess of a metal compound, such as an oxide or hydroxide, with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Detergents that may be suitable for use in the lubricating oil compositions described herein include oil-soluble overbased, low base, or neutral detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols. For example, the metal-containing detergent can include a neutral calcium sulfonate, an overbased calcium sulfonate, a neutral calcium phenate, an overbased calcium phenate, a neutral magnesium sulfonate, an overbased magnesium sulfonate, a neutral magnesium phenate, an overbased magnesium phenate, and mixtures thereof. More than one metal may be present, for example, both calcium and magnesium. Mixtures of calcium and/or magnesium with sodium can also be suitable.

Suitable metal detergents include overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts can also be used.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, from 2:1, from 4:1, from 5:1, from 7:1, or from 10:1.

The metal-containing detergent can be present in the lubricating oil compositions described herein in an amount of from about 0 wt. % to about 10 wt. % or from about 0.1 wt % to about 15 wt % (e.g., from about 0.5 wt. % to about 10 wt. % or from about 0.2 wt. % to about 8 wt. %). For example, the metal-containing detergent can be present in an amount of about 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1 wt. %, 1.5 wt. %, 2 wt. %, 2.5 wt. %, 3 wt. %, 3.5 wt. %, 4 wt. %, 4.5 wt. %, 5 wt. %, 5.5 wt. %, 6 wt. %, 6.5 wt. %, 7 wt. %, 7.5 wt. %, 8 wt. %, 8.5 wt. %, 9 wt. %, 9.5 wt. %, 10 wt. %, 10.5 wt. %, 11 wt. %, 11.5 wt. %, 12 wt. %, 12.5 wt. %, 13 wt. %, 13.5 wt. %, 14 wt. %, 14.5 wt. %, or 15 wt. %. Optionally, the metal-containing detergent can be present in a lubricating oil composition in an amount sufficient to provide from about 500 to about 5,000 ppm alkali and/or alkaline earth metal (e.g., 1,000 ppm to 4,000 ppm; 1,000 ppm to 3,000 ppm; or 2,000 ppm to 3,000 ppm) to the lubricant composition based on a total weight of the lubricant composition.

Antiwear Agents

Antiwear agents suitable for use in the compositions described herein can include phosphorus-based antiwear agents, sulfur-based antiwear agents, and combinations of these. Phosphorus-based antiwear agents for use in the compositions described herein can comprise a metal dihydrocarbyl dithiophosphate compound, such as, but not limited to a zinc dihydrocarbyl dithiophosphate compound. Suitable metal dihydrocarbyl dithiophosphates can include dihydrocarbyl dithiophosphate metal salts wherein the metal may be an alkali or alkaline earth metal, or aluminum, lead, tin, molybdenum, manganese, nickel, copper, or zinc.

Dihydrocarbyl dithiophosphate metal salts can be prepared in accordance with known techniques by first forming a dihydrocarbyl dithiophosphoric acid (DDPA), such as by reacting one or more of an alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used. However, the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and can be represented by the following formula:

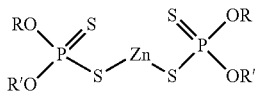

wherein R and R' can be the same or different hydrocarbyl radicals containing from 1 to 18, for example 2 to 12, carbon atoms and including radicals such as alkyl, alkenyl, aryl, arylalkyl, alkaryl, and cycloaliphatic radicals. Optionally, the R and R' groups are alkyl groups of 2 to 8 carbon atoms. For example, the radicals can be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, or butenyl. To obtain oil solubility, the total number of carbon atoms (i.e., R and R') in the dithiophosphoric acid can be about 5 or greater. The zinc dihydrocarbyl dithiophosphate can therefore comprise zinc dialkyl dithiophosphates.

The zinc dihydrocarbyl dithiophosphates can be present in the lubricating oil compositions described herein in an amount of from about 0.1 wt % to about 6 wt % (e.g., from about 0.5 wt. % to about 4 wt. %). For example, the zinc dihydrocarbyl dithiophosphates can be present in an amount of about 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1 wt. %, 1.5 wt. %, 2 wt. %, 2.5 wt. %, 3 wt. %, 3.5 wt. %, 4 wt. %, 4.5 wt. %, 5 wt. %, 5.5 wt. %, or 6 wt. %.

Other suitable components that can be utilized as the phosphorus-based antiwear agent include any suitable organophosphorus compound, such as, but not limited to, phosphoric acid esters or salts thereof; phosphate esters; thiophosphoric acid esters or salts thereof; di-thiophosphoric acid esters or salts thereof; phosphites; phosphonates; phosphorous containing carboxylic esters, ethers, or amides. Suitable examples include tricresyl phosphate (TCP), dialkyl phosphite (e.g., dibutyl hydrogen phosphite), and amyl acid phosphate.

Another suitable component is a phosphorylated succinimide such as a reaction product between a hydrocarbyl substituted succinic acylating agent and a polyamine combined with a phosphorus source, such as an inorganic or organic phosphorus acid or ester. Optionally, the product may have amide, amidine, and/or salt linkages in addition to the imide linkage of the type that results from the reaction of a primary amino group and an anhydride moiety.

The phosphorus-based antiwear agent can be present in the lubricating oil compositions described herein in an amount of from about 0.1 wt % to about 10 wt % (e.g., from about 0.5 wt. % to about 6 wt. % or from about 0.5 wt. % to about 4 wt. %). For example, the phosphorus-based antiwear agent can be present in an amount of about 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1 wt. %, 1.5 wt. %, 2 wt. %, 2.5 wt. %, 3 wt. %, 3.5 wt. %, 4 wt. %, 4.5 wt. %, 5 wt. %, 5.5 wt. %, 6 wt. %, 6.5 wt. %, 7 wt. %, 7.5 wt. %, 8 wt. %, 8.5 wt. %, 9 wt. %, 9.5 wt. %, or 10 wt. %.

The phosphorus-based antiwear agent can be present in a lubricating oil composition in an amount sufficient to provide from about 200 ppm to about 2000 ppm phosphorus. For example, the phosphorus-based antiwear agent can be present in an amount sufficient to provide from about 300 ppm to about 1500 ppm phosphorus, from about 500 ppm to about 800 ppm phosphorus, or from about 800 ppm to about 1200 ppm phosphorus.

Optionally, the phosphorus-based antiwear agent can be present in a lubricating oil composition in an amount sufficient to provide a ratio of alkali and/or alkaline earth metal content (ppm) based on the total amount of alkali and/or alkaline earth metal in the lubricating composition to phosphorus content (ppm) based on the total amount of phosphorus in the lubricating composition of from about 1.6 to about 3.0 (ppm/ppm).

In some examples, the antiwear agents suitable for use in the compositions described herein can include sulfur-based antiwear agents. Suitable sulfur-based antiwear agents include, for example, sulfurized olefins and thiocarbamate-containing compounds including thiocarbamate esters and dithiocarbamate compounds.

The sulfur-based antiwear agent can be present in the lubricating oil compositions described herein in an amount of from about 0.1 wt % to about 6 wt % (e.g., from about 0.5 wt. % to about 4 wt. %). For example, the sulfur-based antiwear agent can be present in an amount of about 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1 wt. %, 1.5 wt. %, 2 wt. %, 2.5 wt. %, 3 wt. %, 3.5 wt. %, 4 wt. %, 4.5 wt. %, 5 wt. %, 5.5 wt. %, or 6 wt. %.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants as disclosed in U.S. Pat. No. 5,883,057.

The boron-containing compound, if present, can be used in an amount sufficient to provide up to about 8 wt. %, from about 0.01 wt. % to about 7 wt. %, from about 0.05 wt. % to about 5 wt. %, or from about 0.1 wt. % to about 3 wt. % of the lubricating oil composition.

Additional Dispersants

The lubricating oil compositions as described herein can optionally include an additional dispersant. Additional dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729, all of which are incorporated herein by reference.

Optionally, the additional dispersant is present in an amount of up to about 10 wt. %, based on the final weight of the lubricating oil composition. For example, the additional dispersant can be present in an amount of from about 2 wt. % to about 10 wt. %, from about 3 wt. % to about 9 wt. %, or from about 5 wt. % to about 7 wt. %. Optionally, the additional dispersant is present in an amount of 1 wt. %, 1.5 wt. %, 2 wt. %, 2.5 wt. %, 3 wt. %, 3.5 wt. %, 4 wt. %, 4.5 wt. %, 5 wt. %, 5.5 wt. %, 6 wt. %, 6.5 wt. %, 7 wt. %, 7.5 wt. %, 8 wt. %, 8.5 wt. %, or 9 wt. %.

Antioxidants

Antioxidants or oxidation inhibitors reduce the tendency of base stocks to deteriorate in service. Deterioration can be evidenced by the products of oxidation, such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols (e.g., calcium nonylphenol sulfide), ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890, incorporated herein by reference.

Other antioxidants that can be used include sterically hindered phenols and esters thereof, diarylamines, alkylated phenothiazines, sulfurized compounds, and ashless dialkyldithiocarbamates. Non-limiting examples of sterically hindered phenols include, but are not limited to, 2,6-di-tertiary butylphenol; 2,6 di-tertiary butyl methylphenol; 4-ethyl-2,6-di-tertiary butylphenol; 4-propyl-2,6-di-tertiary butylphenol; 4-butyl-2,6-di-tertiary butylphenol; 4-pentyl-2,6-di-tertiary butylphenol; 4-hexyl-2,6-di-tertiary butylphenol; 4-heptyl-2,6-di-tertiary butylphenol; 4-(2-ethylhexyl)-2,6-di-tertiary butylphenol; 4-octyl-2,6-di-tertiary butylphenol; 4-nonyl-2,6-di-tertiary butylphenol; 4-decyl-2,6-di-tertiary butylphenol; 4-undecyl-2,6-di-tertiary butylphenol; 4-dodecyl-2,6-di-tertiary butylphenol; methylene bridged sterically hindered phenols, including but not limited to, 4,4-methylenebis(6-tert-butyl-o-cresol), 4,4-methylenebis(2-tert-amyl-o-cresol), 2,2-methylenebis(4-methyl-6 tert-butylphenol), and 4,4-methylene-bis(2,6-di-tert-butylphenol); and mixtures thereof, as described in U.S. Publication No. 2004/0266630, incorporated herein by reference.

Diarylamine antioxidants include, but are not limited to, diarylamines having the formula:

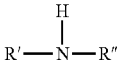

wherein R' and R" each independently represents a substituted or unsubstituted aryl group having from 6 to 30 carbon atoms. Exemplary substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms (e.g., from 4 to 18 carbon atoms or from 4 to 9 carbon atoms). Optionally, one or both aryl groups are substituted, e.g. mono-alkylated diphenylamine, di-alkylated diphenylamine, or mixtures of mono- and di-alkylated diphenylamines.

The diarylamines can contain more than one nitrogen atom in the molecule. Thus, the diarylamine can contain at least two nitrogen atoms wherein at least one nitrogen atom has two aryl groups attached thereto, e.g., as in the case of various diamines having a secondary nitrogen atom as well as two aryls on one of the nitrogen atoms.

Examples of diarylamines that can be used include, but are not limited to, diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

Suitable sulfur-containing antioxidants include, but are not limited to, sulfurized olefins that are characterized by the type of olefin used in their production and the final sulfur content of the antioxidant. Optionally, the olefins include high molecular weight olefins, e.g., those olefins having an average molecular weight of 168 to 351 g/mole. Examples of olefins that can be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins can be isomerized before the sulfurization reaction or during the sulfurization reaction. Structural and/or conformational isomers of the alpha olefin that contain internal double bonds and/or branching can also be used. For example, isobutylene is a branched olefin counterpart of the alpha-olefin 1-butene.

Sulfur sources that can be used in the sulfurization reaction of olefins include elemental sulfur, sulfur monochloride, sulfur dichloride, sodium sulfide, sodium polysulfide, and mixtures of these added together or at different stages of the sulfurization process.

Unsaturated oils, because of their unsaturation, can also be sulfurized and used as an antioxidant. Examples of oils or fats that can be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 wt. % sulfur, when added to the finished lubricant at a 1.0 wt. % treat level, will deliver 2000 ppm of sulfur to the finished lubricant. A sulfurized fatty oil or olefin containing 10 wt. % sulfur, when added to the finished lubricant at a 1.0 wt. % treat level, will deliver 1000 ppm sulfur to the finished lubricant. It is desirable that the sulfurized olefin or sulfurized fatty oil to deliver between 200 ppm and 2000 ppm sulfur to the finished lubricant.

The antioxidant can be present in the lubricating oil compositions described herein in an amount of up to about 5 wt. % (e.g., from about 0.01 wt. % to about 3 wt. %). For example, the antioxidant can be present in an amount of about 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1 wt. %, 1.5 wt. %, 2 wt. %, 2.5 wt. %, 3 wt. %, 3.5 wt. %, 4 wt. %, 4.5 wt. %, or 5 wt. %.

Anti-foam Agents

In some embodiments, anti-foam agents or foam inhibitors can be used in the lubricating oil compositions described herein. The anti-foam agents can be selected from silicones, polyacrylates, and the like. The amount of anti-foam agent in the lubricating oil formulation described herein can range from about 0.001 wt. % to about 0.15 wt. % based on the total weight of the formulation. For example, the anti-foam agent can be present in an amount of from about 0.004 wt. % to about 0.008 wt. %. In some examples, the anti-foam agent can be present in an amount of 0.001 wt. %, 0.002 wt. %, 0.003 wt. %, 0.004 wt. %, 0.005 wt. %, 0.006 wt. %, 0.007 wt. %, 0.008 wt. %, 0.009 wt. %, 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.15 wt. %, 0.2 wt. %, 0.25 wt. %, 0.3 wt. %, 0.35 wt. %, 0.4 wt. %, 0.45 wt. %, 0.5 wt. %, 1 wt. %, 1.5 wt. %, 2 wt. %, 2.5 wt. %, 3 wt. %, 3.5 wt. %, 4 wt. %, 4.5 wt. % or 5 wt. %.

Friction Modifiers

Optionally, the lubricating oil compositions described herein can further include one or more friction modifiers. Suitable friction modifiers can include metal-containing or metal-free friction modifiers. For example, the friction modifiers can include imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, and the like.

Suitable friction modifiers can optionally contain hydrocarbyl groups that are selected from straight chain, branched chain, or aromatic hydrocarbyl groups or admixtures thereof, and may be saturated or unsaturated. The hydrocarbyl groups can be composed of carbon and hydrogen or hetero atoms such as sulfur or oxygen. The hydrocarbyl groups can range from about 12 to about 25 carbon atoms and can be saturated or unsaturated. In some embodiments, the friction modifier may be a long chain fatty acid ester. In another embodiment, the long chain fatty acid ester may be a mono-ester, a di-ester, or a (tri)glyceride. The friction modifier may be a long chain fatty amide, a long chain fatty ester, a long chain fatty epoxide derivative, or a long chain imidazoline.

Aminic friction modifiers can include amides of polyamines. Such compounds can have hydrocarbyl groups that are linear, either saturated or unsaturated, or a mixture thereof and may contain from about 12 to about 25 carbon atoms.

Further examples of suitable friction modifiers include alkoxylated amines and alkoxylated ether amines. Such compounds can have hydrocarbyl groups that are linear, either saturated, unsaturated, or a mixture thereof, and can optionally contain from about 12 to about 25 carbon atoms. Examples include ethoxylated amines and ethoxylated ether amines.

The amines and amides can be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, incorporated herein by reference.

Optionally, suitable friction modifiers can include an organic, ashless (metal-free), nitrogen-free organic friction modifier. Such friction modifiers can include esters formed by reacting carboxylic acids and anhydrides with alkanols. Other useful friction modifiers generally include a polar terminal group (e.g., carboxyl or hydroxyl) covalently bonded to an oleophilic hydrocarbon chain. Esters of carboxylic acids and anhydrides reacted with alkanols are described in U.S. Pat. No. 4,702,850, incorporated herein by reference. Another example of an organic ashless nitrogen-free friction modifier is known generally as glycerol monooleate (GMO), which can contain mono- and diesters of oleic acid. Further examples of suitable ashless friction modifiers are described in U.S. Pat. No. 6,723,685, incorporated herein by reference.

The ashless friction modifier may be present in the lubricant composition in an amount ranging from about 0.1 wt. % to about 0.4 wt. % based on a total weight of the lubricant composition. For example, the friction modifier can be present in an amount of from about 0.1 wt. % to about 1 wt. %. In some examples, the friction modifier can be present in an amount of about 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1 wt. %, 1.5 wt. %, or 2 wt. %.

Molybdenum-Containing Components

The lubricating oil compositions described herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment, the oil-soluble molybdenum compound may be selected from the group consisting of molybdenum dithiocarbamates, molybdenum dialkyldithiophosphates, amine salts of molybdenum compounds, and mixtures thereof. In one embodiment, the oil-soluble molybdenum compound may be a molybdenum dithiocarbamate.

Suitable examples of molybdenum compounds which may be used include commercial materials sold under the trade names such as Molyvan 822™, Molyvan™ A, Molyvan2000™, and Molyvan855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; U.S. RE 37,363 E1; U.S. RE 38,929 E1; and U.S. RE 40,595 E1, incorporated herein by reference in their entireties.

Additionally, the molybdenum compound can be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoCl_4$, $MoO_2Br_2$, $Mo_2O_3Cl_6$, molybdenum trioxide, or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/0689, which are herein incorporated by reference.

Suitable molybdenum dithiocarbamates can be represented by the formula:

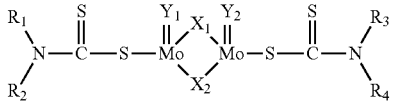

where $R_1$, $R_2$, $R_3$, and $R_4$ each independently represent a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group containing an ester, ether, alcohol, or carboxyl group; and $X_1$, $X_2$, $Y_1$, and $Y_2$ each independently represent a sulfur or oxygen atom.

Examples of suitable groups for each of $R_1$, $R_2$, $R_3$, and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R_1$ to $R_4$ can each have $C_6$ to $C_{18}$ alkyl groups. $X_1$ and $X_2$ can be the same, and $Y_1$ and $Y_2$ may be the same. Optionally, $X_1$ and $X_2$ can both comprise sulfur atoms. Optionally, $Y_1$ and $Y_2$ may both comprise oxygen atoms.

Further examples of molybdenum dithiocarbamates include $C_6$-$C_{18}$ dialkyl or diaryldithiocarbamates, or alkylaryldithiocarbamates such as dibutyl-, diamyl-di-(2-ethylhexyl)-, dilauryl-, dioleyl-, and dicyclohexyl-dithiocarbamate.

Another class of suitable organo-molybdenum compounds are trinuclear molybdenum compounds, such as those of the formula $Mo_3S_kL_nQ_z$ and mixtures thereof, wherein L represents independently selected ligands having organo groups with a sufficient number of carbon atoms to render the compound soluble or dispersible in the oil, n is from 1 to 4, k is from 4 through 7, Q is selected from the group of neutral electron donating compounds such as water, amines, alcohols, phosphines, and ethers, and z ranges from 0 to 5 and includes non-stoichiometric values. At least 21 total carbon atoms can be present among all the ligands' organo groups, such as at least 25, at least 30, or at least 35 carbon atoms. Additional suitable molybdenum compounds are described in U.S. Pat. No. 6,723,685, herein incorporated by reference.

The molybdenum compound may be present in a fully formulated engine lubricant in an amount to provide about 5 ppm to 200 ppm molybdenum. As a further example, the molybdenum compound may be present in an amount to provide about 50 to 100 ppm molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, the oil-soluble transition metal-containing compounds may function as antiwear agents, friction modifiers, antioxidants, deposit control additives, or more than one of these functions. In an embodiment, the oil-soluble transition metal-containing compound may be an oil-soluble titanium compound, such as a titanium (IV) alkoxide. Among the titanium containing compounds that may be used in, or which may be used for preparation of the oil-soluble materials, are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including, but not limited to, titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed herein include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine; or (c) a hydroxy-containing polyester dispersant prepared by the reaction of a substituted succinic anhydride with a polyol, an aminoalcohol, a polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and a C6 to C25 carboxylic acid. The reaction product may be represented by the following formula:

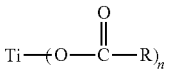

wherein n is an integer selected from 2, 3 and 4, and R is a hydrocarbyl group containing from about 5 to about 24 carbon atoms, or by the formula:

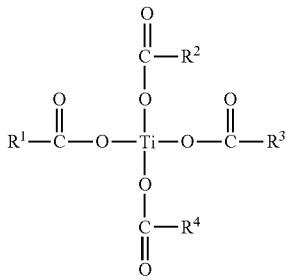

wherein each of $R^1$, $R^2$, $R^3$, and $R^4$ are the same or different and are selected from a hydrocarbyl group containing from about 5 to about 25 carbon atoms. Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment, the oil soluble titanium compound may be present in the lubricating oil composition in an amount to provide from 0 ppm to about 3000 ppm titanium by weight, from about 25 ppm to about 1500 ppm titanium by weight, from about 35 ppm to about 500 ppm titanium by weight, or from about 50 ppm to about 300 ppm titanium by weight.

Viscosity Index Improvers

The lubricating oil compositions described herein also may optionally contain one or more viscosity index improvers in addition to the dispersant viscosity improver. Suitable additional viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in U.S. Publication No. 2012/0101017.

The total amount of viscosity index improver and/or dispersant viscosity index improver may be from about 0 wt. % to about 20 wt. %, from about 0.1 wt. % to about 15 wt. %, from about 0.1 wt. % to about 12 wt. %, or from about 0.5 wt. % to about 10 wt. %, of the lubricating oil composition.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oils described herein will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides, and (ethylene oxide-propylene oxide) polymers; pour point depressants, including esters of maleic anhydride-styrene, polymethacrylates, polyacrylates or polyacrylamides.

Suitable pour point depressants may include a polymethylmethacrylates or mixtures thereof. Pour point depressants may be present in an amount sufficient to provide from about 0 wt. % to about 1 wt. %, from about 0.01 wt. % to about 0.5 wt. %, or from about 0.02 wt. % to about 0.04 wt. % based upon the final weight of the lubricating oil composition.

Suitable rust inhibitors, which are also referred to herein as corrosion inhibitors, may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable rust or corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount of from about 0 wt. % to about 5 wt. %, from about 0.01 wt. % to about 3 wt. %, or from about 0.1 wt. % to about 2 wt. %, based upon the final weight of the lubricating oil composition.

In general terms, a suitable engine lubricant of the present invention may include additive components in the ranges listed in Table 2.

TABLE 2

| Component | Wt. % (Broad) | Wt. % (Typical) |
|---|---|---|
| Dispersant Viscosity Index Improver | 1.5-2.0 | 1.5-2.0 |
| Functionalized Dispersant (Reaction product of Components A, B, C, and/or D) | 0.5-10.0 | 5.0-5.5 |
| Additional Dispersants | 0-10 | 2.0-4.0 |
| Antioxidants | 0-5.0 | 2.0-3.0 |
| Metal Detergents | 0-15.0 | 1.5-5.0 |
| Antifoaming agents | 0-5.0 | 0.01-0.15 |
| Antiwear agents | 0-6.0 | 1.00-2.00 |
| Pour point depressant | 0-5.0 | 0.01-1.5 |
| Viscosity modifier | 0-20.00 | 0.01-10.0 |
| Corrosion Inhibitor | 0-5.0 | 0-2.0 |
| Friction modifiers | 0-2.0 | 0.01-0.5 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Such additive compositions are described below.

II. Additive Compositions

The use of an additive composition or concentrate may take advantage of the mutual compatibility afforded by the combination of ingredients when in the form of an additive concentrate. Also, the use of a concentrate may reduce blending time and may lessen the possibility of blending errors.

The additive compositions described herein include an amine-functionalized olefin copolymer dispersant viscosity index improver comprising a reaction product of an acylated olefin copolymer and a polyamine and a functionalized dispersant, as described herein. The dispersant viscosity index improver can be present in the additive composition in an amount of from about 8 wt. % to about 12 wt. % based on the weight of the additive composition. For example, the dispersant viscosity index improver can be present in an amount of from about 9 wt. % to about 11 wt. % based on the weight of the additive composition. The functionalized dispersant can be present in the additive composition in an amount of from about 10 wt. % to about 20 wt. % based on the weight of the additive composition. For example, the functionalized dispersant can be present in an amount of from about 10 wt. % to about 12 wt. % based on the weight of the additive composition.

Optionally, the weight ratio of the functionalized dispersant to the dispersant viscosity index improver is from about 1.5:1 to about 3:1 (e.g., from about 2:1 to about 3:1 or from about 2.7:1 to about 3:1).

The additive compositions can also include the additional components described above, including detergents (e.g., metal detergents), friction modifiers, additional dispersants, antiwear agents, antifoam agents, antioxidants, viscosity modifiers, pour point depressants, corrosion inhibitors and the like.

III. Methods of Use

The lubricating oil compositions described herein can be used in methods for lubricating an engine. For example, the methods for lubricating an engine can include supplying to an engine the lubricating oil composition as described herein. As described above, suitable engines for use in these methods include diesel engines (e.g., heavy duty diesel engines), marine engines, rotary engines, turbine engines, locomotive engines propulsion engines, aviation piston engines, stationary power generation engines, continuous power generation engines, and engines comprising silver parts.

The lubricating oil compositions described herein can be used to control soot induced viscosity increase in an engine lubricant. The methods include lubricating the an engine with the lubricating oil composition as described herein. The effectiveness of the composition in controlling soot induced viscosity increase can be determined using ASTM D7156.

The lubricating oil compositions described herein can also be used to reduce oil mist separator filter plugging in an engine. In addition, the compositions reduce or prevent sludge formation in an oil mist separator. The compositions can also be used to control wear during operation of an engine.

The examples below are intended to further illustrate certain aspects of the methods and compositions described herein, and are not intended to limit the scope of the claims.

EXAMPLES

Soot Induced Viscosity Increase Control and Sludge Build-Up Testing

Soot Induced Viscosity Increase Control Testing

Examples 1-4 were tested to determine whether the compositions are effective in controlling soot induced viscosity increase in an engine lubricant according to ASTM D7156. Each of the Examples 1-4 were fully formulated 15W-40 heavy duty engine oils. The data are shown below in Table 3.

TABLE 3

| Component[2] | Example 1 (Wt. %) | Example 2 (Wt. %) | Example 3 (Wt. %) | Example 4 (Wt. %) |
|---|---|---|---|---|
| Dispersant Viscosity Index Improver | 0 | 3.0 | 1.2 | 1.8 |
| Functionalized Dispersant (Reaction product of Components A, B, C, and/or D) | 5.5 | 4.1 | 4.5 | 5.0 |
| Additional Dispersant 1 (polyisobutenyl succinimide) | 1.0 | 2.6 | 0 | 0.5 |
| Additional Dispersant 2 (borated polyisobutenyl succinimide) | 2.0 | 0 | 2 | 1.0 |
| Overbased Calcium Sulfonate Detergent (300 TBN and 11.9% Ca) | 0.8 | 0.7 | 0.7 | 1.0 |
| Neutral Calcium Sulfonate Detergent (28 TBN and 2.6% Ca) | 0.3 | 0.3 | 0.3 | 0.3 |
| Overbased Calcium Phenate Detergent (250 TBN and 9.25% Ca) | 1.5 | 1.5 | 1.5 | 1.0 |
| Antiwear Agents[3] | 1.36 | 1.2 | 1.2 | 1.36 |
| Hindered Antioxidant | 1.0 | 0.75 | 0.75 | 1.0 |
| Diarylamine Antioxidant | 1.5 | 1.3 | 1.3 | 1.5 |
| Antifoam Agent | 0.01 | 0.01 | 0.01 | 0.01 |
| Mineral Oil | 1.42 | 1.42 | 1.44 | 1.42 |
| Friction Modifier | 0.04 | 0 | 0.05 | 0.04 |
| Pour-Point Depressant | 0.1 | 0.1 | 0.1 | 0.1 |
| Additional Viscosity Modifier | 7.0 | 5.0 | 8.3 | 6.5 |
| Base Oil | Balance | Balance | Balance | Balance |
| ASTM D7156 | Fail | Pass | Fail | Pass |

[2]In Examples 1-4, the additive compositions were blended and subsequently added to the base oil along with the Additional Viscosity Modifier.

[3]The Antiwear Agents in the Examples are as follows:

Example 1 and Example 4: zinc dithiophosphoric acid made by reacting a mixture of primary and secondary alcohols.

Example 2: zinc dithiophosphoric acid made by reacting all secondary alcohols.

Example 3: mixture of two zinc dithiophosphoric acids. One of the zinc dithiophosphoric acids is made by reacting a mixture of primary and secondary alcohols and the other is made by reacting all secondary alcohols.

The elemental composition and properties of the oil were tested and are shown below in Table 4.

TABLE 4

| Property | Example 1 | Example 2 | Example 3 | Example 4 |
|---|---|---|---|---|
| Boron Content | 0.016 | 0.000 | .015 | 0.008 |
| Calcium Content | 0.232 | 0.233 | .236 | 0.219 |
| Sulfur Content | 0.380 | 0.300 | .300 | 0.35 |
| Nitrogen Content | 0.171 | 0.153 | 0.138 | 0.153 |
| Phosphorus Content | 0.114 | 0.100 | .097 | 0.100 |
| Zinc Content | 0.124 | 0.118 | 0.107 | 0.13 |
| TBN | 9.6 mg KOH/g | 9.5 mg KOH/g | 6.9 mg KOH/g | 9.0 mg KOH/g |
| Sulfated Ash | <1.0 | <1.0 | <1.0 | <1.0 |
| Saturates | 95 | 95 | 95 | 95 |
| Sulfur in base oil | 0.001 | 0.001 | 0.001 | 0.001 |
| KV at 100° C. | 15.8 | 15.4 | 15.8 | 15.0 |
| KV at 40° C. | 121 | 120 | 121 | 120 |
| Viscosity index of base oil | 138 | 125 | 125 | 125 |

As shown in Table 3, Examples 2 and 4, containing at least 1.8 wt. % of the dispersant viscosity index improver and a functionalized dispersant, passed the test directed to controlling soot induced viscosity increase. The Examples 1 and 3, which contained less than 1.8 wt. % of the dispersant viscosity index improver and comparable amounts of the functionalized dispersant did not pass the test.

Sludge Build-Up Testing

Lubricating oil compositions containing varying amounts of dispersant viscosity index improver were tested to determine the amount of engine sludge-build up after subjecting engines treated with the compositions to field tests. The field tests for Examples 5-10 were performed using two different types of heavy duty engines vehicles. Examples 5-7 were performed using 2015 Freightliner Cascadia vehicles (Daimler Trucks North America LLC; Portland, Oreg.) equipped with Detroit Diesel DD15 14 L, 475 HP engines (Detroit Diesel Corporation; Detroit, Mich.). The field tests for Examples 8-10 were performed using 2012 Freightliner vehicles (Daimler Trucks North America LLC; Portland, Oreg.) equipped with Detroit Diesel DD15 14.5 L, 455 HP engines (Detroit Diesel Corporation; Detroit, Mich.).

The engines were treated with lubricating oil compositions containing different amounts of dispersant viscosity index improver. The composition components for Examples 5, 6, 7, and 8 are listed in Table 5. Examples 9 and 10 are commercial oils containing 3.5% of a dispersant viscosity index improver.

TABLE 5

| Component[4] | Example 5 (Wt. %) | Example 6 (Wt. %) | Example 7 (Wt. %) | Example 8 (Wt. %) |
|---|---|---|---|---|
| Dispersant Viscosity Index Improver | 1.8 | 1.8 | 1.8 | 5.0 |
| Functionalized Dispersant (Reaction product of Components A, B, C, and/or D) | 5.44 | 5.2 | 5.2 | — |
| Additional Dispersant 1 (2100 MW polyisobutenyl succinimide) | 2.0 | 1.0 | 1.0 | 4.0 |
| Additional Dispersant 2 (1300 MW borated polyisobutenyl succinimide) | 2.0 | 2.0 | 2.0 | 2.2 |
| Additional Dispersant 3 (1600 MW polyisobutenyl succinimide) | — | — | — | 1.5 |
| Overbased Calcium Sulfonate Detergent (300 TBN and 11.9% Ca) | 0.7 | 0.7 | 0.7 | 0.92 |
| Neutral Calcium Sulfonate Detergent (28 TBN and 2.6% Ca) | 0.3 | 0.3 | 0.3 | — |
| Overbased Calcium Phenate Detergent (250 TBN and 9.25% Ca) | 1.5 | 1.5 | 1.5 | 1.71 |

TABLE 5-continued

| Component[4] | Example 5 (Wt. %) | Example 6 (Wt. %) | Example 7 (Wt. %) | Example 8 (Wt. %) |
|---|---|---|---|---|
| Antiwear Agents[5] | 1.4 | 1.6 | 1.33 | 0.94 |
| Hindered Antioxidant | 0.9 | 1.0 | 1.0 | 0.7 |
| Diarylamine Antioxidant | 1.5 | 1.6 | 1.5 | 0.5 |
| Antifoam Agent | 0.01 | 0.01 | 0.01 | 0.01 |
| Mineral Oil | 1.95 | 1.75 | 2.42 | 2.18 |
| Friction Modifiers | — | 0.04 | 0.04 | 0.15 |
| Pour-Point Depressant | — | — | — | 0.1 |
| Viscosity Modifiers | 2.7 | 0.25 | 0.25 | 2.7 |
| Base Oils | Balance | Balance | Balance | Balance |

[4]In Examples 5-8, the additive compositions were blended and subsequently added to the base oil along with the Additional Viscosity Modifier.
[5]The Antiwear Agents in the Examples are as follows:
Example 5: zinc dithiophosphoric acid made by reacting all secondary alcohols.
Examples 6 and 7: mixture of dithiocarbamates and zinc dithiophosphoric acids made by reacting all secondary alcohols.
Example 8: mixture of two zinc dithiophosphoric acids. One of the zinc dithiophosphoric acids is made by reacting a mixture of primary and secondary alcohols and the other is made by reacting all secondary alcohols.

Examples 5, 6, and 7 are fully formulated 10W-30 heavy duty engine oils. Example 8 is a fully formulated 10W-40 heavy duty engine oil and does not pass ASTM D7156. Example 9 is fully formulated 5W-30 heavy duty engine oil and passes ASTM D7156. Example 10 is a commercial 15W-40 heavy duty engine oil and passes ASTM D7156. The vehicles were driven for a number of miles, as indicated in Table 6 below.

The degrees of sludge build-up in the engines were determined by visually inspecting the engines and assigning a rating of 0-5 to indicate the level of sludge build-up. Ratings of 0, 1, and 2 indicate a passing value for sludge build-up, as evidenced by an operational disc separator where reliability of the disc separator is not endangered. A rating of 3 is a borderline pass/fail value, as the disc separator is operational but the reliability of the disc separator is endangered. Ratings of 4 and 5 are failing values and indicate severe sludge build-up and plugging of at least 50% of drainage holes. At ratings 4 and 5, the separation efficiency is either deteriorated or non-existent.

TABLE 6

| | Ex. 5 | Ex. 5' (Formulation of Ex. 5 tested in second engine) | Ex. 6 | Ex. 6' (Formulation of Ex. 6 tested in second engine) | Ex. 7 | Ex. 8 | Ex. 9 | Ex. 10 |
|---|---|---|---|---|---|---|---|---|
| Test Miles | 152,074 | 229,617 | 87,207 | 283,198 | 271,073 | 19,861 | 116,720 | 123,650 |
| Dispersant Viscosity Index Improver (wt. %) | 1.8 | 1.8 | 1.8 | 1.8 | 1.8 | 5 | 3.5 | 3.5 |
| Functionalized Dispersant (wt. %) | 5.44 | 5.44 | 5.2 | 5.2 | 5.2 | 0 | 0 | 0 |
| Sludge Build Up | 1 | 1 | 0 | 1 | 1 | 3 | 3 | 3 |

As shown in Table 6, the engines containing formulations having at least 3.5 wt. % of a dispersant viscosity index improver resulted in unfavorable sludge build-up ratings of 3 or 4 (see Examples 8, 9, and 10). However, engines containing formulations having less than 2 wt. %, such as 1.8 wt. %, of a dispersant viscosity index improver had favorable ratings of 0 or 1 (see Examples 5, 5', 6, 6', and 7).

The soot induced viscosity increase control and sludge build-up testing data show that the amount of dispersant viscosity index improver and the presence of a functionalized dispersant are important factors that affect the performance of the lubricating oil composition.

As shown above in Table 3, the soot induced viscosity increase control test data show that dispersant viscosity index improver amounts of less than 1.5 wt. % (e.g., 0 wt. % and 1.2 wt. %) resulted in failing soot induced viscosity increase control performance. The data also show that the compositions that passed the soot induced viscosity increase control test included greater than 1.5 wt. % of the dispersant viscosity index improver and also included a functionalized dispersant. In particular, Examples 2 and 5, containing at least 1.8 wt. % of the dispersant viscosity index improver and a functionalized dispersant, passed the test directed to controlling soot induced viscosity increase. Whereas, Examples 1 and 3, which contained less than 1.8 wt. % of the dispersant viscosity index improver and comparable amounts of the functionalized dispersant did not pass the test.

Furthermore, the sludge build-up test data (Table 6) show that dispersant viscosity index improver amounts of less than approximately 2 wt. % (e.g., 1.8 wt. %), in the presence of a functionalized dispersant, resulted in passing values for the sludge build-up test. However, including the dispersant viscosity index improver in amounts greater than approximately 2 wt. % (e.g., 3.5 wt. % or 5 wt. %) resulted in failing values for the sludge build-up test.

The data above demonstrate that to achieve passing values for both tests, the range of dispersant viscosity index improver in the lubricant composition should be between 1.5 wt. % and 2.0 wt. % and the lubricant composition should include a functionalized dispersant.

The compositions and methods of the appended claims are not limited in scope by the specific compositions and methods described herein, which are intended as illustrations of a few aspects of the claims and any compositions and methods that are functionally equivalent are within the scope of this disclosure. Various modifications of the compositions and methods in addition to those shown and described herein are intended to fall within the scope of the appended claims. Further, while only certain representative compositions, methods, and aspects of these compositions and methods are specifically described, other compositions and methods are intended to fall within the scope of the appended claims. Thus a combination of steps, elements, components, or constituents may be explicitly mentioned herein; however, all other combinations of steps, elements, components, and constituents are included, even though not explicitly stated. All publications, patents, and patent applications cited herein are hereby incorporated by reference in their entireties for all purposes.

What is claimed is:

1. A method of lubricating a heavy duty diesel engine, comprising:

supplying to a heavy duty diesel engine a lubricating oil composition comprising:

a major amount of an oil of lubricating viscosity;

an amine-functionalized olefin copolymer dispersant viscosity index improver comprising a reaction product of an acylated olefin copolymer and a polyamine, wherein the amine-functionalized olefin copolymer dispersant viscosity index improver is present in an amount of about 1.8 wt. % based on the weight of the lubricating oil composition; and a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

2. A method of controlling soot induced viscosity increase in an engine lubricant, comprising:

lubricating a heavy duty diesel engine with a lubricating oil composition comprising:

a major amount of an oil of lubricating viscosity;

an amine-functionalized olefin copolymer dispersant viscosity index improver comprising a reaction product of an acylated olefin copolymer and a polyamine, wherein the amine-functionalized olefin copolymer dispersant viscosity index improver is present in an amount of about 1.8 wt. % based on the weight of the lubricating oil composition; and a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

3. A method of reducing oil mist separator filter plugging in a heavy duty diesel engine, comprising:

lubricating a heavy duty diesel engine with a lubricating oil composition comprising:

a major amount of an oil of lubricating viscosity;

an amine-functionalized olefin copolymer dispersant viscosity index improver comprising a reaction product of an acylated olefin copolymer and a polyamine, wherein the amine-functionalized olefin copolymer dispersant viscosity index improver is present in an amount of about 1.8 wt. % based on the weight of the lubricating oil composition; and a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

4. The method of claim 1, wherein the amine-functionalized olefin copolymer dispersant viscosity index improver comprises an olefin copolymer having grafted thereon from 0.3 to 0.75 carboxylic groups per 1000 number average molecular weight units of olefin copolymer.

5. The method of claim 4, wherein the olefin copolymer has a number average molecular weight of between about 40,000 and about 150,000.

6. The method of claim 4, wherein the olefin copolymer is a copolymer of ethylene and one or more $C_3$-$C_{23}$ alpha-olefins.

7. The method of claim 1, wherein the dispersant is present in an amount of from about 2 wt. % to about 10 wt. %.

8. The method of claim 1, wherein the dispersant is present in an amount of from about 5 wt. % to about 5.5 wt %.

9. The method of claim 1, wherein component (A) comprises a polyalkenyl-substituted succinic acid or anhydride.

10. The method of claim 1, wherein component (C) comprises 1,8-naphthalic anhydride.

11. The method of claim 1, wherein component (D) comprises maleic anhydride.

12. The method of claim 1, wherein from about 0.25 to 1.5 moles of component (C) is reacted per mole of component (B).

13. The method of claim 1, wherein from about 0.25 to 1.5 moles of component (D) is reacted per mole of component (B).

14. The method of claim 1, wherein the oil of lubricating viscosity comprises a Group II oil.

15. The method of claim 1, wherein the oil of lubricating viscosity meets a SAE 10W-30 engine oil specification.

16. The method of claim 1, wherein the oil of lubricating viscosity meets a a SAE 15W-40 engine oil specification.

17. The method of claim 1, wherein the dispersant is a reaction product of A and B, post-treated with both C and D.

18. The method of claim 1, further comprising a metal-containing detergent.

19. The method of claim 1, further comprising an additional dispersant.

20. The method of claim 19, wherein the additional dispersant comprises one or more polyalkenyl succinimide dispersants.

21. The method of claim 1, wherein the lubricating oil composition is a heavy duty engine oil composition.

22. A method of lubricating a heavy duty diesel engine, comprising:

supplying to a heavy duty diesel engine a lubricating oil composition comprising:

(i) a major amount of an oil of lubricating viscosity;

(ii) an amine-functionalized olefin copolymer dispersant viscosity index improver comprising a reaction product of an acylated olefin copolymer and a polyamine, wherein the amine-functionalized olefin copolymer dispersant viscosity index improver is present in an amount of from about 1.6 wt. % to about 1.8 wt. % based on the weight of the lubricating oil composition; and (iii) a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

23. A method of making a lubricating oil composition for use in a heavy duty diesel engine, comprising combining:

(i) a major amount of an oil of lubricating viscosity;

(ii) an amine-functionalized olefin copolymer dispersant viscosity index improver comprising a reaction product of an acylated olefin copolymer and a polyamine; and (iii) a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500, wherein the amine-functionalized olefin copolymer dispersant viscosity index improver is present in an amount of from about 1.6 wt. % to about 1.8 wt. % based on the weight of the lubricating oil composition.

24. A method of making a lubricating oil composition for use in a heavy duty diesel engine, comprising combining:

(i) a major amount of an oil of lubricating viscosity; and (ii) an additive composition comprising:

an amine-functionalized olefin copolymer dispersant viscosity index improver comprising a reaction product of an acylated olefin copolymer and a polyamine, wherein the amine-functionalized olefin copolymer dispersant viscosity index improver is present in an amount of from about 8 wt. % to about 12 wt. % based on the weight of the additive composition; and a dispersant comprising a reaction product of components (A) a hydrocarbyl-dicarboxylic acid or anhydride having a number average molecular weight of from about 500 to about 5000 and (B) at least one polyamine, wherein the reaction product is post-treated with (C) an aromatic carboxylic acid, an aromatic polycarboxylic acid, or an aromatic anhydride, wherein all carboxylic acid or anhydride groups are attached directly to an aromatic ring, and/or (D) a non-aromatic dicarboxylic acid or anhydride having a number average molecular weight of less than about 500.

25. The method of claim 24, wherein the amine-functionalized olefin copolymer dispersant viscosity index improver is present in the additive composition in an amount of from about 9 wt. % to about 11 wt. %.

26. The method of claim 24, wherein a weight ratio of the dispersant to the amine-functionalized olefin copolymer dispersant viscosity index improver is from about 1.5:1 to about 3:1.

27. The method of claim 26, wherein the weight ratio of the dispersant to the amine-functionalized olefin copolymer dispersant viscosity index improver is from about 2:1 to about 3:1.

28. The method of claim 26, wherein the weight ratio of the dispersant to the amine-functionalized olefin copolymer dispersant viscosity index improver is from about 2.7:1 to about 3:1.

29. The method of claim 24, wherein the dispersant is present in the additive composition in an amount of from about 10 wt. % to about 20 wt. %.

30. The method of claim 24, wherein the dispersant is present in the additive composition in an amount of from about 10 wt. % to about 12 wt. %.

* * * * *